US007076973B1

(12) United States Patent
Chesebro, Jr. et al.

(10) Patent No.: US 7,076,973 B1
(45) Date of Patent: Jul. 18, 2006

(54) METHOD AND APPARATUS FOR MAKING A SOCK HAVING A LOOPED TAB

(75) Inventors: Robert E. Chesebro, Jr., Sheboygan, WI (US); Steven K. Roe, Waldo, WI (US)

(73) Assignee: Wigwam Mills, Inc., Sheboygan, WI (US)

( * ) Notice: Subject to any disclaimer, the term of this patent is extended or adjusted under 35 U.S.C. 154(b) by 179 days.

(21) Appl. No.: 11/045,763

(22) Filed: Jan. 28, 2005

(51) Int. Cl.
*D04B 9/46* (2006.01)

(52) U.S. Cl. ..... 66/178 R; 2/239

(58) Field of Classification Search ..... 66/178 R, 66/179–188; 2/239–242
See application file for complete search history.

(56) References Cited

U.S. PATENT DOCUMENTS 1,806,492 A 5/1931 Nestler
1,816,475 A * 7/1931 Emery ..... 66/172 R
1,995,261 A 3/1935 Gidney
3,130,566 A * 4/1964 Chesebro ..... 66/171
3,274,804 A * 9/1966 Thorneburg et al. ..... 66/171
3,289,329 A 12/1966 Weiss
3,601,818 A * 8/1971 Chesebro et al. ..... 2/239
D225,490 S 12/1972 Sindelar et al.
3,975,929 A 8/1976 Fregeolle
3,990,115 A * 11/1976 Nester ..... 2/239
5,428,975 A * 7/1995 Lee et al. ..... 66/178 R
5,440,901 A * 8/1995 Seino et al. ..... 66/47

FOREIGN PATENT DOCUMENTS

GB 2 271 923 A 5/1994

* cited by examiner

*Primary Examiner*—Danny Worrell
(74) *Attorney, Agent, or Firm*—Alston & Bird LLP

(57) ABSTRACT

There is provided a sock formed on a circular knitting machine. The sock has a tubular body including a cuff defining an opening to receive the foot of the wearer and includes a toe portion, a foot portion, a heel and a relatively narrow looped tab loop comprising a knit strip integrally knit onto the opening at the top of the tubular body and including opposed ends. The knit strip is folded intermediate the ends to provide a loop having inner and outer layers with open opposed sides, and the ends of the inner and outer layers of the looped tab and connecting the same to the cuff whereby the looped tab extends downwardly therefrom and is adapted to be disposed on the outside of the shoe. The sock knit strip comprises a plurality of knit courses of equal length having opposed selvage ends and the length of the knit courses forming the looped tab are preferably less than one-fourth the length around the opening. The socks may be made in different styles such as a footlet or an over the calf sock having a leg portion merging substantially at the ankle of a wearer. The invention also contemplates a method of knitting a sock having a looped tab knitted to the cuff and adapted to be disposed on the outside of the shoe. The present invention also provides an apparatus for use on a circular knitting machine for forming the looped tabs.

12 Claims, 2 Drawing Sheets

METHOD AND APPARATUS FOR MAKING A SOCK HAVING A LOOPED TAB

FIELD OF THE INVENTION

The present invention relates to knitted socks and to a method of forming same. More particularly, the present invention relates to knitted socks having a loop knitted to the opening thereof forming a tab, to a method for making the looped tab, and to a device for attachment to a circular knitting machine for forming the looped tab.

BACKGROUND OF THE INVENTION

Many styles and types of socks have incorporated one or more support tabs sewn or attached to the upper edge thereof at the opening. The tabs are often used on footlet-styled socks used for sports activities. Another type of sock on which tabs are sewn or attached to the upper edge of the opening are hunting socks. The tabs serve various functions, for example, preventing a footlet from sliding downwardly inside a shoe between the wearer's heel and the heel portion of the shoe and allowing the wearer to more easily don the sock. Tabs have also been used on hosiery for other reasons. For example, plurality of tabs may be attached at predetermined intervals around the top of the stocking above a turned welt for attachment of the stocking to a garter.

An example of a footlet-styled sock is disclosed in U.S. Pat. No. 3,130,566 to Chesebro in which a footlet has a support tab disposed in juxtaposed relation to the heel and has an inner end connected to the heel adjacent the upper edge thereof and a free outer terminal end. The support tab is a pair of integrally knit juxtaposed gussets each including a plurality of courses connected to corresponding courses of the other gusset and adapted to be disposed on the outside of the sock. The sock blank includes a first narrowed gusset formed of a plurality of partial courses, the first of which is knit integrally with a portion of the last starter course by approximately half of the needles of the cylinder, the remaining half of the needles being deactivated and holding the last formed stitches thereon. The partial courses of the first narrowed gusset are progressively decreased in length by successively deactivating one or more of the endmost needles at the ends of the partial courses with the last formed stitches at opposite ends of the partial courses being held on the deactivated needles. A first widened gusset is then knit integrally with the first narrowed gusset by progressively reactivating the previously deactivated needles in the formation of the first gusset. The partial courses of the first widened gusset are thereby progressively increased in length and have the endmost stitches joined with the endmost stitches of the partial courses of the first narrowed gusset. The gussets cooperate to define a support tab pocket and the joined stitches of the partial courses form suture or gore lines at opposite sides of the support tab pocket. The remainder of the sock is then knit.

A more recent version of a footlet-style sock is shown in U.S. Pat. No. 3,601,818 to Chesebro, et al. and U.S. Design Pat. No. 225,490 to Sindelar and Chesebro. The sock blank includes a conventional makeup at the upper end and a plurality of courses form a selvage portion. Then the needle cylinder is reciprocated while the major portion of the needles in the cylinder are switched to an inactive position to hold the stitch loops formed during knitting of the last course of the selvage portion. A small number of active needles continue to form stitch loops with swinging movement of the needle cylinder in each direction to form a plurality of successive partial courses of equal width to complete knitting of a tab. The needle cylinder then switches to continuous rotation. As the needles at the opposite sides of the tab again form stitch loops, the fabric at opposite sides is joined and the inner end portion of the knit strip forming the tab are drawn together but are not directly joined. The knitting continues until the sock blank is formed. The foot-receiving opening is then formed by cutting the blank. An overedge seam is formed by stitched around the edge of the foot-receiving opening and connecting the ends of the outwardly protracting loop to the edge of the foot-receiving opening to normally maintain the loop in depending relation above the heel-embracing portion. A sewing machine having cutting blades that cuts the blank immediately prior to the formation of the overedge stitching is used. As the overedge seam and corresponding cuts are made across the juxtapositioned inners ends of the support tab, the folded upper end of the inner layer of the support tab and the upper end of the ankle and the free end of the outer layer of the support tab are joined by the overedge seam.

Despite the advantages of the above described socks, it has been found desirable to provide a knitted sock having a loop knitted to the rear portion of the sock at the opening and to provide an apparatus for knitting such loop.

SUMMARY OF THE INVENTION

The present invention is directed to a sock formed on a circular knitting machine and adapted to be worn inside a shoe. The sock has a tubular body including an upper edge or cuff defining an opening therein adapted to receive the foot of the wearer through the opening. The tubular body includes a toe portion, a foot portion, a heel and a relatively narrow looped tab loop comprising a knit strip integrally knit onto the opening at the top of the tubular body and including opposed ends. The knit strip is folded intermediate the ends to provide a loop having upper and lower layers with open opposed sides, and the ends of the upper and lower layers of the looped tab and connecting the same to the upper edge or cuff whereby the looped tab extends downwardly therefrom and is adapted to be disposed on the outside of the shoe.

The sock knit strip comprises a plurality of knit courses of equal length having opposed selvage ends and the length of the knit courses forming the looped tab are preferably less than one-fourth the length around the opening. The socks may be made in different styles such as a footlet or an over the calf sock having a leg portion merging substantially at the ankle of a wearer. The sock may be made of natural yarns, synthetic yarns or combinations of natural and synthetic yarns.

The invention also contemplates a method of knitting a sock on a circular knitting machine. The sock has a looped tab thereon adapted to be disposed on the outside of the shoe when the sock is worn inside the shoe. The method comprises knitting a plurality of complete seamless courses to form an upper cuff edge portion; then knitting a plurality of partial courses of equal length integral with a few wales of the last course of the cuff edge while holding the stitch loops in the remaining wales of the last of said cuff courses. The plurality of partial courses having opposed cuff edges and form a relatively narrow knit strip. Then knitting the upper edge of the loop to the opening; and forming a tubular body having an upper edge defining an opening therein adapted to receive the foot of the wearer, the tubular body including a toe portion, a foot portion, a heel embracing portion, and a leg portion merging substantially at the ankle of a wearer.

Lastly, the present invention also provides an apparatus for use on a circular knitting machine for forming the looped tabs.

It is a general object of the present invention to provide a knitted sock that has a knitted loop at the rear portion thereof at the opening and to a method for making same.

Another object of the present invention is to provide an apparatus for knitting a loop in the rear of the opening of a knitted sock.

Other objects, features and advantages of the present invention will become apparent from the following detailed description of the invention taken with the accompanied drawings.

BRIEF DESCRIPTION OF THE DRAWINGS

Figure 1:
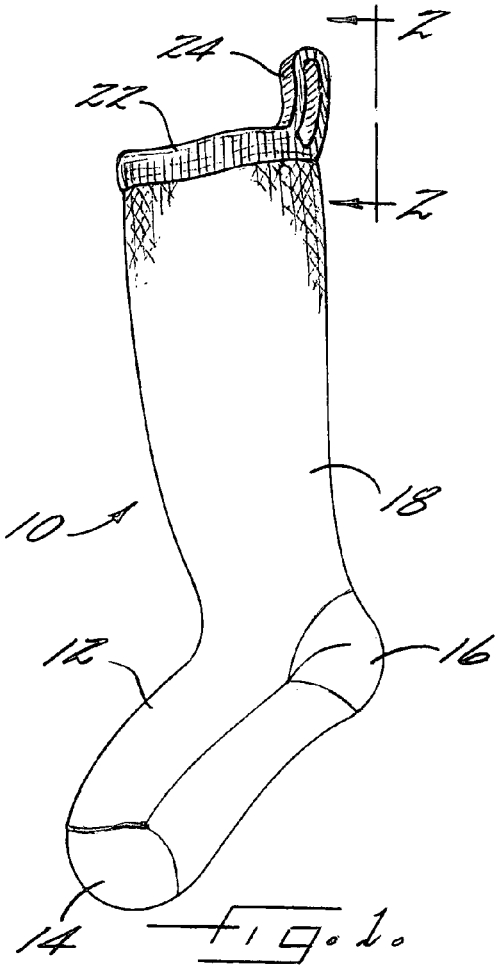
Figure 2:
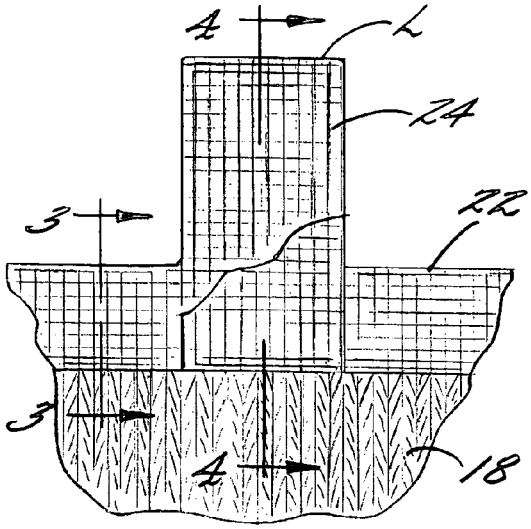
Figure 3:
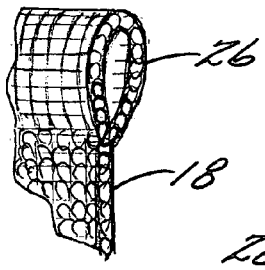
Figure 4:
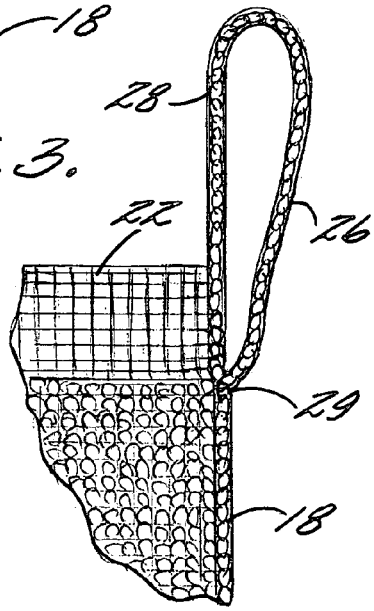
Figure 5:
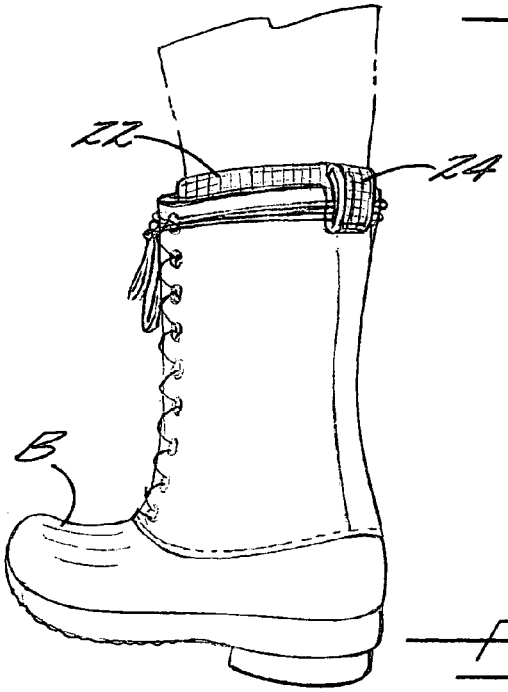
Figure 6:
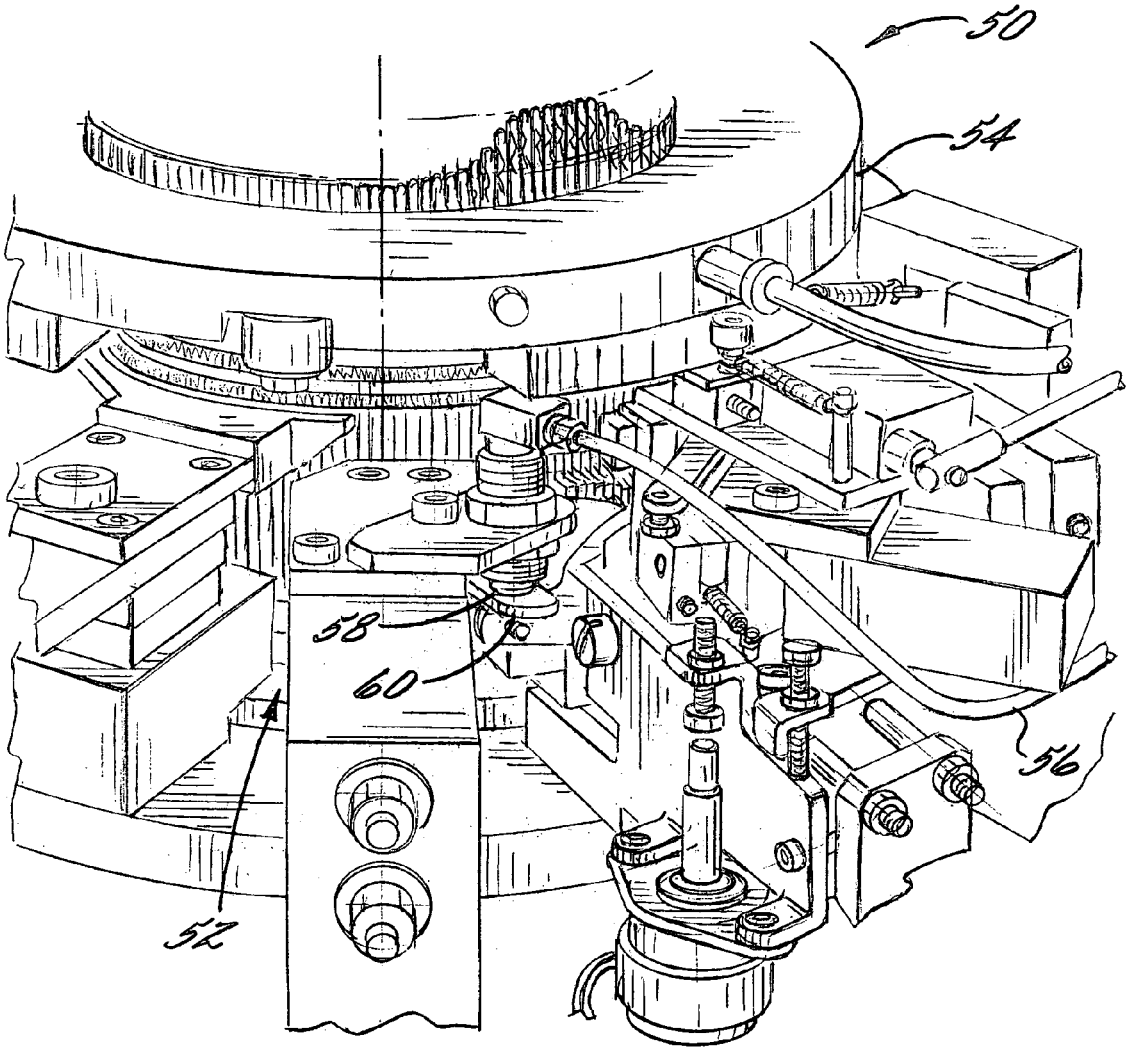
Figure 7:
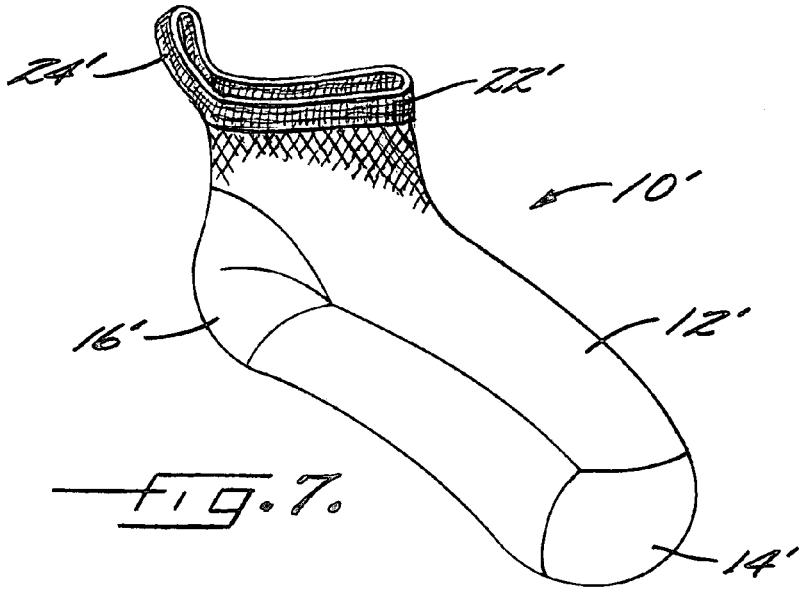

Having thus described the invention in general terms, reference is now made to the accompanying drawings, which are not necessarily drawn to scale, and wherein:

FIG. 1 is a side elevation view of an over the calf sock having a knitted loop tab of the present invention;

FIG. 2 is an enlarged fragmentary view of the knitted loop structure of the sock illustrated in FIG. 1 taken along line 2—2;

FIG. 3 is a partial view of the loop tab of the present invention taken along line 3—3 of FIG. 2;

FIG. 4 is a side view of the loop tab of the present invention taken along line 4—4 of FIG. 2;

FIG. 5 is an enlarged perspective view showing an example of a finished the sock of the present invention being worn inside a boot;

FIG. 6 is a view of a circular knitting machine showing the attachment required for the production of loops for socks of the present invention; and FIG. 7 is a view of the footlet sock that includes a foot portion extending from a toe portion to a heel pocket and a cuff at its upper end defining a top opening.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 illustrates an embodiment of a boot-style sock according to the present invention and generally denoted by the numeral 10. The sock 10 is knit on a circular knitting machine and is characterized by having a loop 24 knit onto a cuff 22 at its upper end defining an opening therein adapted to receive the foot of the wearer. Turning to the sock in more detail, sock 10 has a tubular body having a foot portion 12 extending from a toe portion 14 to a heel pocket 16 and a leg portion 18 having a lower end extending from the heel pocket 16 of foot portion 12 and a cuff 22 at its upper end defining a top opening. In another embodiment, that of a footlet-style sock as shown in FIG. 7, the sock 10' does not have a leg portion 18 as the loop 24' is knit directly above the heel portion. As shown in FIG. 7 the footlet sock 10' includes a foot portion 12' extending from a toe portion 14' to a heel pocket 16' and a cuff 22' at its upper end defining a top opening.

As shown in FIG. 2, the looped tab 24 is a relatively narrow knit strip integrally knit onto the opening at cuff 22 at the top of leg portion 18 and including opposed ends. As shown in FIGS. 3 and 4, the knit strip is folded intermediate the ends to provide a loop tap 24 having outer layer 26 and inner layer 28 with open opposed sides. The knit strip comprises a plurality of knit courses of equal length L having opposed selvage ends. In a preferred embodiment, the length of the knit courses forming the looped tab 24 is less than one-fourth the length around the opening at cuff 22. The knit strip is knit to form the inner layer 28 followed by the outer layer 26 of the looped tab 24. The end of outer layer 26 is automatically joined by knitting the outer end to the cuff 22 as shown at 29 in FIG. 4.

The purpose of the loop tab 24 is to enable the person who wears the sock to don and doff it more easily. For example, it is envisioned that this sock is to be made initially for sportsmen's socks such as the one shown in FIG. 5 with loop tab 24 extending above and downwardly from outside the rear of the boot B. The socks according to this invention may be a variety of styles including crew socks; quarter socks or low cut socks (footlets) or a sock with a leg portion merging substantially at the ankle of a wearer. Other functions of the loop 24 enable the person wearing the sock to run the shoelaces through the loop 24 to keep the sock secure at the tops of the boot. The loops could also be connected during the laundering of the sock so that they don't get separated in the washing machine or the dryer.

As will be understood by those skilled in the art, the socks of the present invention can be made with various types of yarn in various weights. The selection of natural or synthetic yarn, textures, and patterns is dependent on the anticipated use to which the socks may be put. For example, the sole portion of the foot portion 12 may be reinforced or made thicker or the foot portion 12 may have terry loops knit therein.

The present invention also contemplates a method of knitting a sock 10 on a circular knitting machine and adapted to be worn inside a shoe. The sock 10 has a looped tab 24 thereon adapted to be disposed on the outside of the shoe. The sock includes a conventional makeup at the upper end wherein a plurality of complete seamless courses is knit to form an upper cuff 22 edge portion. Then the needle cylinder is reciprocated while the major portion of the needles in the cylinder are switched to an inactive position to hold the stitch loops formed during knitting of the last course of the cuff 22.

A plurality of partial courses of equal length integral with a few wales of the last course of the cuff edge are knitted while holding the stitch loops in the remaining wales of the last of said cuff courses. The plurality of partial courses has opposed edges and forms a relatively narrow knit strip. A small number of active needles continue to form stitch loops with swinging movements of the needle cylinder in each direction to form a plurality of successive partial courses of equal width to complete knitting of the tab forming the loop 24. The needle cylinder then switches to continuous rotation. As the needles at the opposite sides of the tab again form stitch loops, the fabric at opposite sides is joined and the inner end portion of the knit strip forming the tab are drawn together but are not directly joined. The outer edge of the knit strip is then automatically knitted to the upper cuff edge portion at the opening.

The knitting continues until the tubular body is formed. As noted the tubular body has an upper edge defining an opening therein adapted to receive the foot of the wearer therethrough. As shown in FIG. 1 and discussed above, the tubular body including a toe portion 14, a foot portion 12, a heel pocket 16, and in some embodiments a leg portion 18 merging substantially at the ankle of a wearer.

In accordance with the present invention, the sock 10 may be knit on any conventional circular knitting machine having provision for holding stitch loops on a certain group of adjacent needles while continuing to knit on the remaining needles for a predetermined number of courses and then for again knitting on all of the needles. Two examples of which are a 4 inch diameter 156 needle cylinder circular hosiery knitting machine with a cooperating dial having needles therein and with or without a toe closing device, and a 4 inch diameter 112 needle cylinder circular knitting machine with a cooperating dial and a toe device. Such knitting machines are conventionally provided with two yarn feeds that supply yarns to the cylinder and dial needles at spaced apart locations around the circular knitting machine.

In FIG. 6 there is shown a partial view of a circular knitting machine 50. A picker controller 52 is mounted under the dial cap 54. A pneumatic line 56 connects the picker control to the computer. The picker controller 52 includes an air piston 58 that is controlled by the knitting machine program. The piston 58 operates to move lever 60, to disable the picker allowing the "pull loop" to be knit. When the piston 58 is activated the lever 60 is moved downwardly. The lever 60 lifts the picker above the path of the active needles and below the inactive needles. This allows consecutive courses to be knit without the removal or introduction of additional needles in a reciprocating motion. Upon completion of the desired courses, all the needles are returned to the active race. The piston 58 is then deactivated allowing the normal knitting of the rest of the sock.

The raised needles are out of action and the lowered needles are positioned to knit the loop tab 24. Unlike a conventional heel or toe where reciprocation occurs with needles being raised and lowered this loop tab is knit with the same number of needles throughout so that all parts of it have an equal number of wales.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A footlet sock formed on a circular knitting machine and adapted to be worn inside a shoe comprising:

(a) foot portion extending from a toe portion to a heel embracing portion and a cuff defining an opening therein adapted to received by the foot of the wearer therethrough;

(b) a relatively narrow looped tab comprising a knit strip integrally knit onto said opening and including opposed ends, said knit strip being folded intermediate the ends to provide a loop having upper and lower layers with open opposed sides, and (c) said ends of said inner and outer layers of said looped tab are knit to the rear of said cuff whereby said looped tab extends downwardly therefrom and is adapted to be disposed on the outside of the shoe.

2. The sock according to claim 1 wherein said knit strip comprises a plurality of knit courses of equal length having opposed selvage ends.

3. The sock according to claim 1 wherein the length of the knit courses forming said looped tab is less than one-fourth the length around said opening.

4. The sock according to claim 1 wherein said sock is made of natural yarns, synthetic yarns or combinations of natural and synthetic yarns.

5. A method of knitting a sock on a circular knitting machine and adapted to be worn inside a shoe, said sock having a looped tab thereon adapted to be disposed on the outside of the shoe, said method comprising:

(a) knitting a plurality of complete seamless courses to form an upper cuff edge portion;

(b) knitting a plurality of partial courses at the rear of said cuff edge portion of equal length integral with a few wales of the last course of said cuff edge while holding the stitch loops in the remaining wales of the last of said cuff courses, said plurality of partial courses having opposed cuff edges and forming a relatively narrow knit strip, (c) knitting the outer edge end of the knit strip to the upper cuff edge portion at the opening; and (d) forming a sock having an upper edge defining an opening therein adapted to received the foot of the wearer therethrough, said tubular body including a toe portion, a foot portion, a heel embracing portion.

6. The method of knitting a sock according to claim 5 further comprising knitting a leg portion merging substantially at the ankle of a wearer.

7. The method of knitting a sock according to claim 5 wherein the length of the knit courses forming said looped tab is less than one-fourth the length around said opening.

8. An over the calf sock formed on a circular knitting machine and adapted to be worn inside a shoe comprising:

(a) a tubular body including a cuff defining an opening therein adapted to received by the foot of the wearer therethrough, said tubular body including a toe portion, a foot portion, a heel and;

(b) a relatively narrow looped tab comprising a knit strip integrally knit onto said opening at the top of said tubular body and including opposed ends, said knit strip being folded intermediate the ends to provide a loop having upper and lower layers with open opposed sides, and (c) said ends of said inner and outer layers of said looped tab are knit to the rear of said cuff whereby said looped tab extends downwardly therefrom and is adapted to be disposed on the outside of the shoe.

9. The sock according to claim 8 wherein said knit strip comprises a plurality of knit courses of equal length having opposed selvage ends.

10. The sock according to claim 8 wherein the length of the knit courses forming said looped tab is less than one-fourth the length around said opening.

11. The sock according to claim 8 further comprising a leg portion merging substantially at the ankle of a wearer.

12. The sock according to claim 8 wherein said sock is made of natural yarns, synthetic yarns or combinations of natural and synthetic yarns.

* * * * *